US006533141B1

(12) United States Patent
Petterson et al.

(10) Patent No.: US 6,533,141 B1
(45) Date of Patent: Mar. 18, 2003

(54) INTERMITTENT AEROSOL DISPENSING VALVE

(75) Inventors: Tor H. Petterson, deceased, late of Rancho Palos Verdes, CA (US), by Grace C. Petterson, Executor; Michael G. Knickerbocker, St. George, UT (US); David J. Houser, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/002,657

(22) Filed: Oct. 31, 2001

(51) Int. Cl.[7] ..... G01F 11/00
(52) U.S. Cl. ..... 222/1; 222/645; 222/402.13
(58) Field of Search ..... 222/1, 644, 645, 222/649, 402.11, 402.13, 402.2

(56) References Cited

U.S. PATENT DOCUMENTS 3,419,189 A * 12/1968 Iketani ..... 222/54
3,477,613 A 11/1969 Mangel
3,658,209 A 4/1972 Freeman et al.
4,077,542 A 3/1978 Petterson
4,396,152 A 8/1983 Abplanalp
5,018,963 A 5/1991 Diederich
5,025,962 A * 6/1991 Renfro ..... 222/649
6,216,925 B1 4/2001 Garon ..... 222/645

FOREIGN PATENT DOCUMENTS

EP 826608 A1 3/1998

* cited by examiner

*Primary Examiner*—Joseph A. Kaufman

(57) ABSTRACT

An valve assembly is provided that automatically dispenses aerosol content from a can at predetermined intervals. A diaphragm at least partially defines an accumulation chamber that receives aerosol content from the can during an accumulation phase. Once the internal pressure of the accumulation chamber reaches a predetermined threshold, the diaphragm flexes to initiate a spray phase, during which the aerosol content is delivered from the accumulation chamber to the ambient environment. A rotatable pawl provides resistive pressure and control of diaphragm movement.

11 Claims, 5 Drawing Sheets

FIG. 7
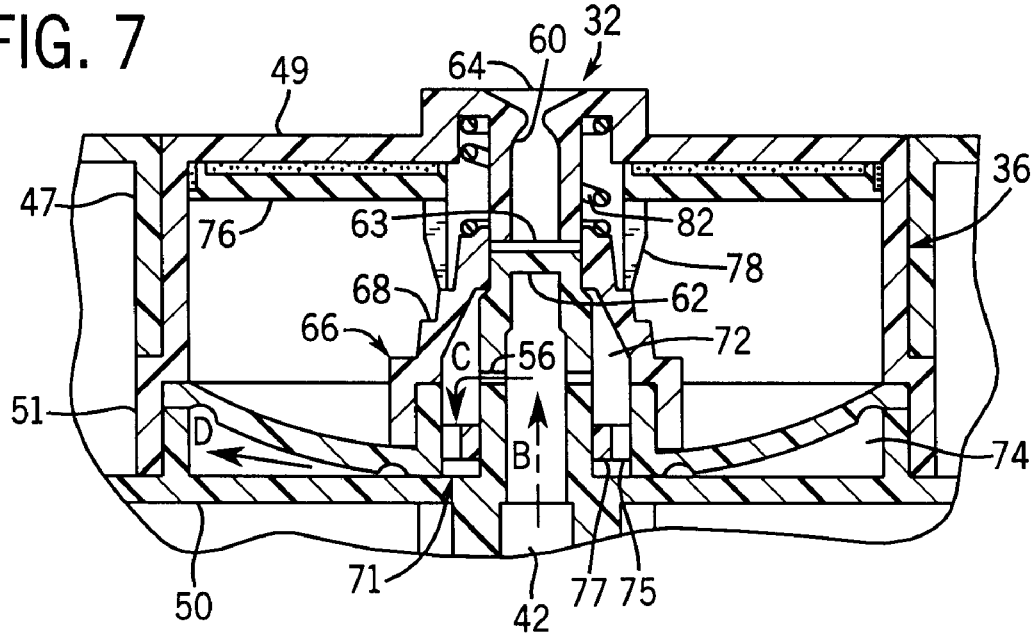
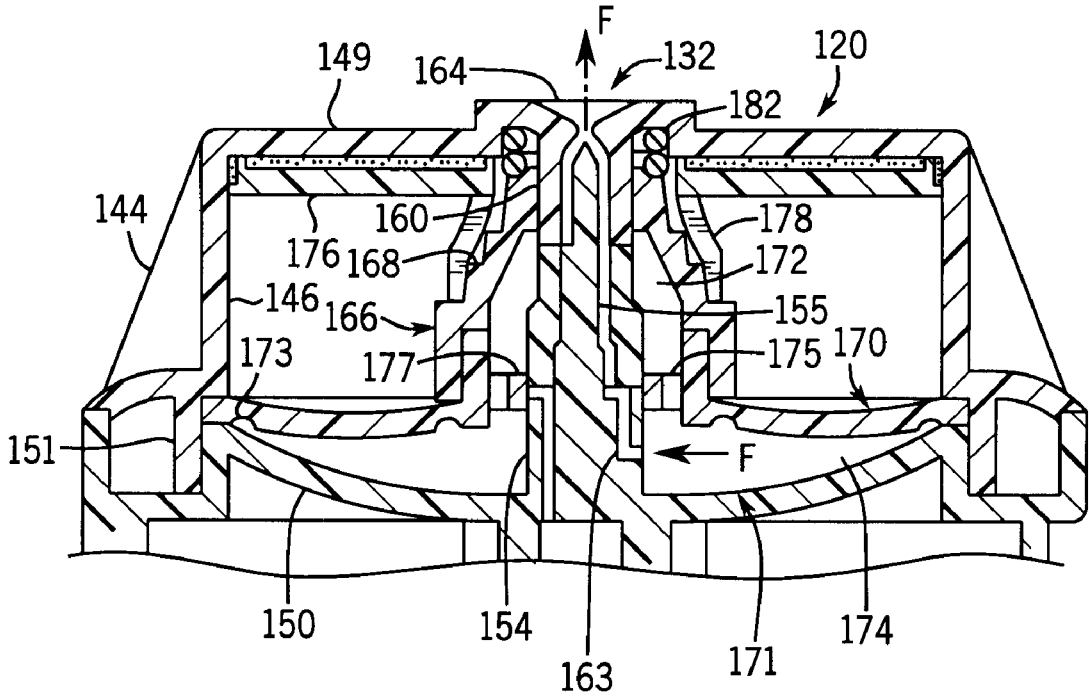
FIG. 9

INTERMITTENT AEROSOL DISPENSING VALVE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol dispensing devices, and in particular to valve assemblies that provide automatic dispensing of aerosol content at predetermined time intervals, without requiring the use of electrical power.

Aerosol cans dispense a variety of ingredients. Typically, an active is mixed with a propellant which may be gaseous, liquid or a mixture of both (e.g. a propane/butane mix; carbon dioxide), and the mixture is stored under pressure in the aerosol can. The active mixture is then sprayed by pushing down/sideways on an activator button at the top of the can that controls a release valve. For purposes of this application, the term "chemical" is used to mean liquid, liquid/gas, and/or gas content of the container (regardless of whether in emulsion state, single phase, or multiple phase).

The pressure on the button is typically supplied by finger pressure. However, for fragrances, deodorizers, insecticides, and certain other actives which are sprayed directly into the air, it is sometimes desirable to periodically refresh the concentration of active in the air. While this can be done manually, there are situations where this is inconvenient. For example, when an insect repellant is being sprayed to protect a room overnight (instead of using a burnable mosquito coil), the consumer will not want to wake up in the middle of the night just to manually spray more repellant.

There are a number of prior art systems for automatically distributing actives into the air at intermittent times. Most of these rely in some way on electrical power to activate or control the dispensing. Where electric power is required, the cost of the dispenser can be unnecessarily increased. Moreover, for some applications power requirements are so high that battery power is impractical. Where that is the case, the device can only be used where linkage to conventional power sources is possible.

Other systems discharge active intermittently and automatically from an aerosol can, without using electrical power. For example, U.S. Pat. No. 4,077,542 relies on a biased diaphragm to control bursts of aerosol gas at periodic intervals. See also U.S. Pat. Nos. 3,477,613 and 3,658,209. However, biased diaphragm systems have suffered from reliability problems (e.g. clogging, leakage, uneven delivery). Moreover, they sometimes do not securely attach to the aerosol can.

Moreover, the cost of some prior intermittent spray control systems makes it impractical to provide them as single use/throw away products. For some applications, consumers may prefer a completely disposable product.

Thus, a need still exists for improved, inexpensive automated aerosol dispensers that do not require electrical power.

BRIEF SUMMARY OF THE INVENTION

In one aspect the invention provides a valve assembly that is suitable to dispense a chemical from an aerosol container.

It can automatically iterate between an accumulation phase where the chemical is received from the container, and a spray phase where the received chemical is automatically dispensed at intervals.

There is a housing mountable on an aerosol container, a movable diaphragm associated with the housing which is linked to a sloped track, the diaphragm being biased towards a first configuration, and an accumulation chamber inside the housing for providing variable pressure against the diaphragm. There is also a first passageway in the housing suitable for linking an interior portion of the aerosol container with the accumulation chamber.

A second passageway in the housing is suitable for linking the accumulation chamber with an outlet of the valve assembly, and a valve stem is positioned in the housing which the sloped track can ride along. A pawl is rotatably positioned on the sloped track to ride on the sloped track. When the diaphragm is in the first configuration the valve assembly can prevent spray of the chemical out of the valve assembly and permit chemical to flow from the aerosol container into the accumulation chamber via the first passageway. When the pressure of chemical inside the accumulation chamber exceeds a specified threshold the diaphragm can move from the first configuration to a second configuration wherein spray is permitted to exit the valve assembly.

In preferred forms a portion of the diaphragm blocks off the first passageway when the diaphragm is in the second configuration, a portion of the sloped track restricts flow to the second passageway when the diaphragm is in the first configuration. A pawl can be linked to a rotor, the rotor having an upper surface that can be at least partially coated with putty. The sloped track preferably is helically sloped. The pawl rides on it to resist movement of the diaphragm from the first configuration to the second configuration. Pressure supplied by the diaphragm towards the pawl can cause the pawl to rotate, thereby permitting movement of the diaphragm towards the second configuration.

A toe of the pawl will flare radially outwardly off of the track when the diaphragm approaches the second configuration. Also, the diaphragm has a radially outward section, a radially inward section, and an orifice there between. In another aspect, the accumulation chamber has a base that is sloped so as to direct liquid chemical that may collect in the accumulation chamber towards the first passageway.

If desired, a spring can be disposed in the housing to resist axial movement of the diaphragm from the first to the second configuration. Also, a porous barrier can be disposed within the housing between the aerosol container and the first passageway. These changes will slow the interval between bursts.

In another aspect, methods are provided for using these valve assemblies with aerosol containers are also disclosed.

The present invention achieves a secure mounting of a valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and begins the cycle of periodic and automatic dispensing of chemical there from. Importantly, periodic operation is achieved without requiring the use of electrical power to motivate or control the valve.

The valve assembly has few parts, and is inexpensive to manufacture and assemble. Further, it does not require the use of small orifices which might be susceptible to clogging, and it is otherwise relatively self-cleaning to help avoid clogs and/or inconsistent bursts. For example, the movement of the pawl along the sloped track avoids residue accumulation along the track.

The foregoing and other advantages of the invention will appear from the following description. In the description reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the scope of the invention.

BRIEF DESCRIPTION OF THE DRAWINGS

FIG. 7 is a view similar to FIG. 3, but of a third embodiment that includes a spring;

FIG. 9 is a view similar to the top portion of FIG. 8, but with the valve in a spray configuration.

DETAILED DESCRIPTION OF THE PREFERRED EMBODIMENT

Figure 1:
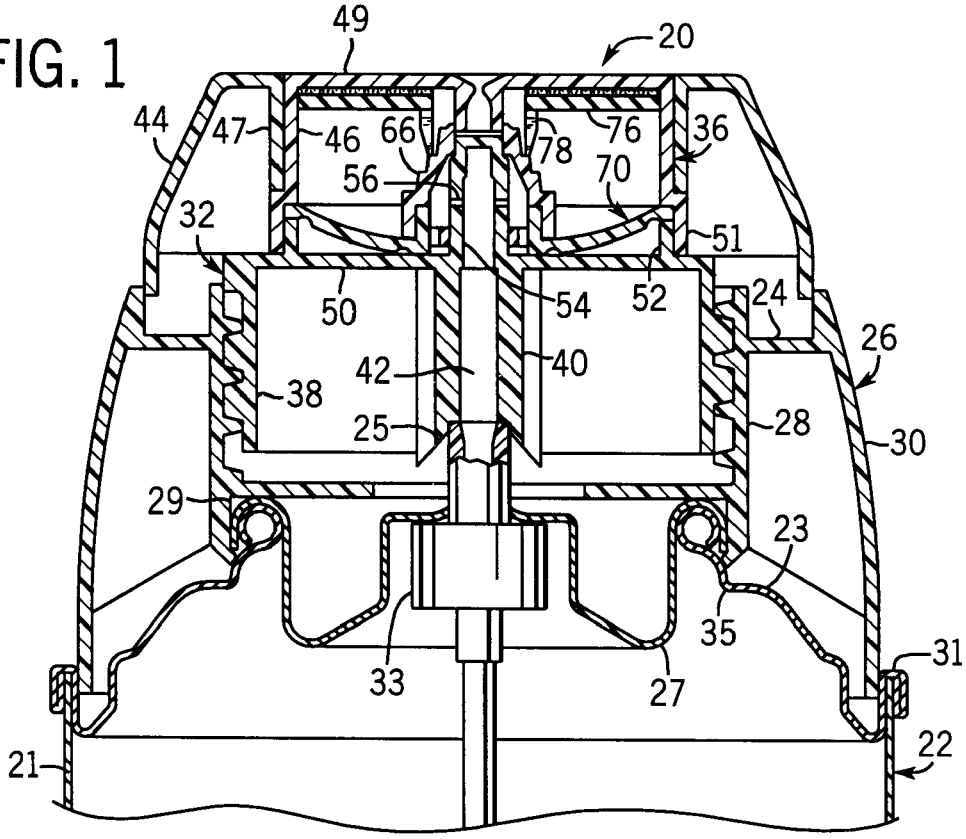
FIG. 1 is a sectional view of an automatic dispensing valve of the present invention in an "off" configuration, mounted onto an aerosol can.

Referring initially to FIG. 1, an aerosol can 22 includes a cylindrical can wall 21 that is closed at its upper margin by the usual dome 23. The joint between the upper margin of the can wall 21 and the dome 23 is the can chime 31. An upwardly open cup 27 is located at the center of the dome 23 and is joined to the dome by rim 29.

A conventional valve 33 is located at the center of the valve cup 27. The valve 33 has an upwardly extending valve stem 25, through which the aerosol contents of the can may be expelled. Valve 33 is shown as a vertically actuated valve, which can be opened by moving the valve stem 25 directly downwardly. Instead, one could use a side-tilt valve where the valve is actuated by tipping the valve stem laterally and somewhat downwardly.

An automatic aerosol dispenser (generally 20) in accordance with the invention is configured for engagement with the vertically actuated type valve 33. The dispenser is mostly polypropylene, albeit other suitable materials can be used.

The dispenser 20 has a mounting assembly 26 including an axially extending inner wall 28 and peripheral skirt 30 that are joined at their axial outer ends. It should be appreciated that throughout this description, the terms "axially outer, axially downstream, axially inner, axially upstream" are used with reference to the longitudinal axis of the container. The term "radial" refers to a direction outward or inward from that axis.

The inner wall 28 and skirt 30 engage the valve cup rim 29 and can chime 31, respectively. In particular, inner wall 28 has a radially inwardly extending flange 35 that is configured to snap-fit over the rim 29, while skirt 30 engages the inner surface of chime 31. In operation, the dispenser 20 is can be forced downwardly onto the chime 18 and rim 29, thus fastening the dispenser 20 to the aerosol can 22. The dispenser 20 can be actuated to activate the flow of aerosol content from the can 22 to the dispenser, as will now be described.

Figure 2:
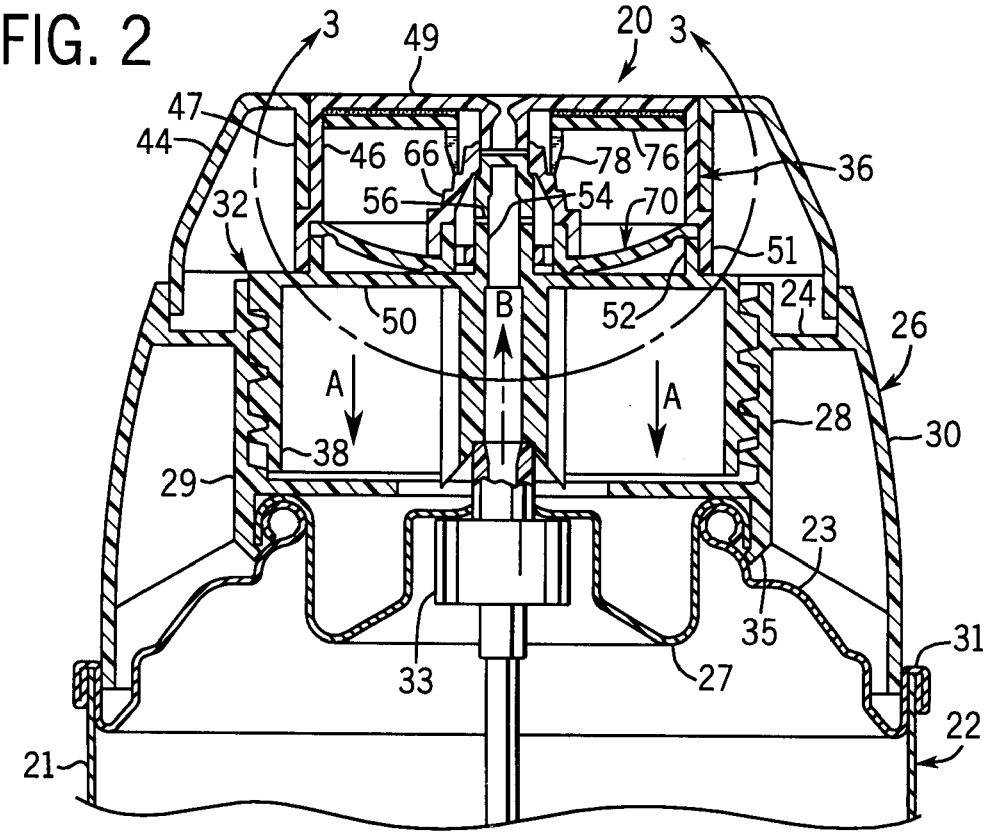
FIG. 2 is a view similar to FIG. 1, but with the valve in an "on" position.

In particular, an inner wall 28 is threaded on its radially inner surface to receive a valve assembly 32 that is rotatable therein. The valve assembly 32 includes an axially extending annular wall 38 that is threaded on its outer surface to engage the threads of inner wall 28. The threads have a predetermined pitch such that, as the valve assembly 32 is rotated clockwise with respect to the assembly 26, it is displaced axially along the direction of arrow A with respect to aerosol can 22, as illustrated in FIG. 2. This initiates an accumulation cycle. A stop 37 engages the rim 29 to limit the amount of permitted axial displacement of the dispenser relative to the can.

Valve assembly 32 further includes an annular wall 40 disposed radially inwardly of wall 38 that defines therein an axially extending cylindrical pathway portion 42. When the dispenser 20 is initially mounted onto aerosol can 22, the axially inner edge of wall 40 is disposed adjacent, and aligned with, the valve stem 25. However, it is not pressing down on stem 25.

Because the valve stem is not activated in this position, the valve assembly 32 has not yet engaged the aerosol can 22, and the assembly is in a storage/shipment position. However, as the valve assembly 32 is rotated to displace the dispenser 20 along the direction of arrow A, wall 40 depresses the valve stem 25, thereby engaging the valve assembly 32 with the aerosol can 22 and allowing the aerosol content to flow from the can into the valve assembly 32.

Valve assembly 32 further includes an annular wall 47 that extends axially downstream from wall 38, and is displaced slightly radially inwardly with respect thereto. An outer annular sealing wall 44 extends axially upstream and radially outwardly from the axially outermost edge of wall 47. The outer surface of axially inner portion of wall 44 engages the inner surface of a flange on skirt 30, and is rotatable with respect thereto to provide a seal between the mounting assembly 26 and valve assembly 32. Wall 44 is also easily engageable by a user to rotate the mounting assembly 26, as described above.

Walls 38 and 40 are connected at their axially outer ends by an annular, radially extending wall 50. An annular axial wall 46 extends downstream from wall 50, and defines at its axially outer edge a seat for an annular radially extending cover 49, which is further supported by wall 47. In particular, cover 49 has an axially inwardly extending flange 51 disposed proximal its radially outer edge that engages the inner surface of wall 47. Wall 47 defines an internal void 36, which is occupied by the valve assembly 32, as is further illustrated with reference now also to FIG. 3. Cover 49 is annular to define a centrally disposed opening that serves as an outlet 64 for aerosol content, as will become more apparent from the description below.

Figure 3:
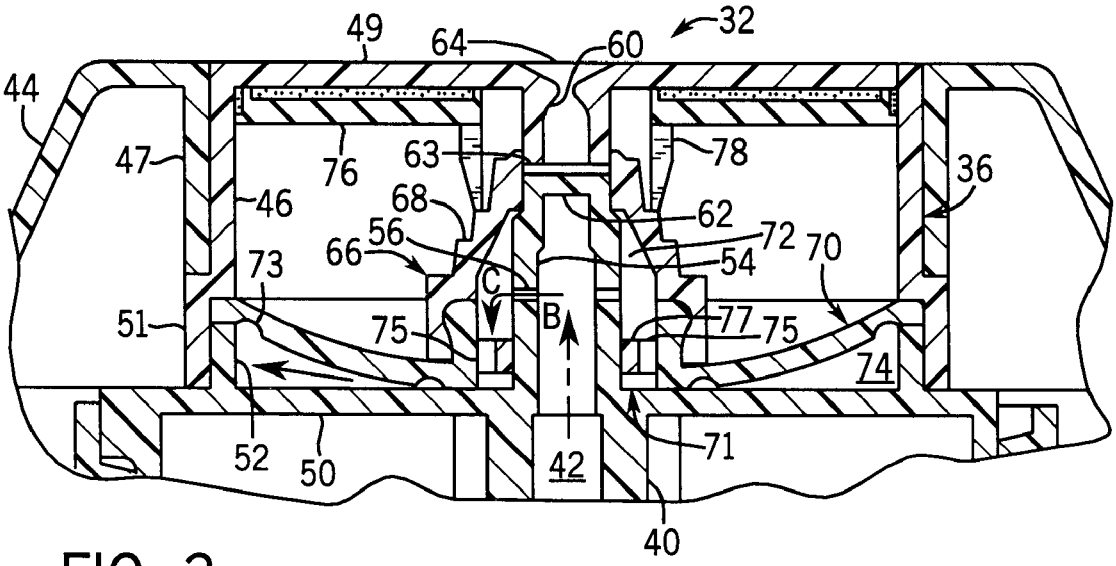
FIG. 3 is an enlarged sectional view taken along line 3—3, during an accumulation portion of the dispensing cycle.
Figure 4:
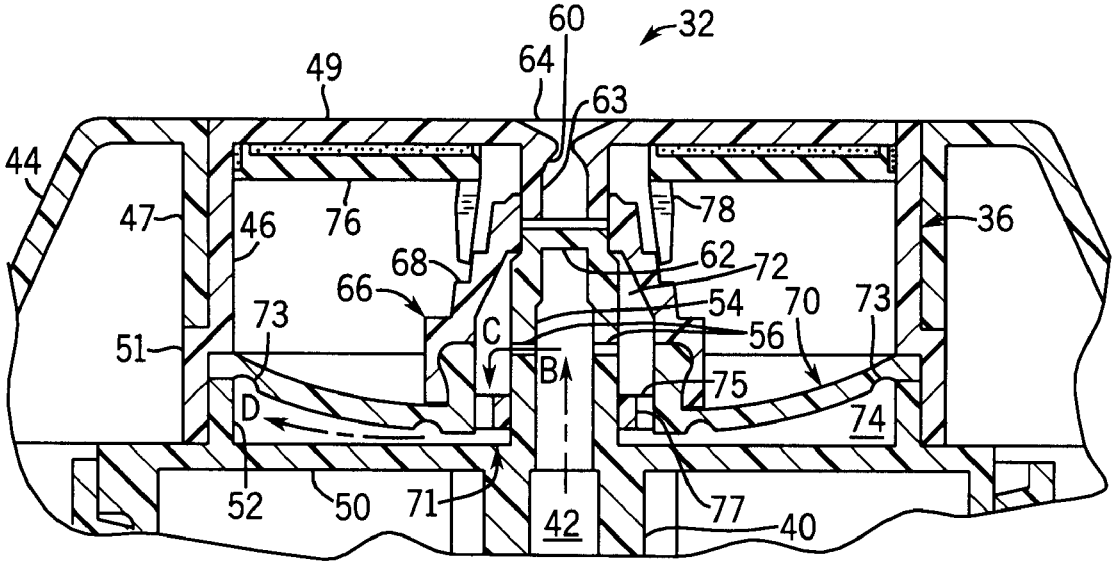
FIG. 4 is a view similar to FIG. 3, but with the accumulation chamber in a partially pressurized state.

As is best seen in FIGS. 3 and 4, valve assembly 32 has an annular base which is defined by that portion of annular wall 50 that extends radially inwardly of flange 52. Walls 50 and 40 are integrally connected to an annular axially extending wall 54 that is substantially aligned with wall 40. Walls 40 and 54, in combination, define the above-described conduit 42 that extends from the valve stem 25 and into valve assembly 32.

A first channel is defined by a slot 56 that extends radially through wall 54 from channel 42 to provide an inlet to an accumulation chamber 71. A radially extending wall 62 is disposed at the axially outer end of wall 54 and terminates channel 42, thereby forcing all aerosol content flowing through conduit 42 into the accumulation chamber 71 during the accumulation cycle.

An annular neck 60 extends axially inwardly from the radially inner edge of cover 49, and is axially aligned with wall 54. Neck 60 terminates slightly axially downstream of wall 62 such that a second channel defined by a slot 63 extends radially between walls 62 and 60, and downstream of channel 56. Neck 60 is in fluid communication with channel 63, and defines a nozzle that terminates in an axially extending outlet 64 of dispenser 20 at its axially outer end. Channel 63 is in fluid communication with the accumulation chamber 71 to deliver stored aerosol content to the outlet 64 as a spray during a spray cycle that follows each accumulation cycle, as will be described in more detail below.

With continuing reference to FIG. 3, annular wall 54 has a stepped outer diameter that provides a seat for a retainer wall 66, which is frustoconical and has a helically sloped track 68 disposed on its outer surface. An annular rotor 76 is disposed axially upstream from, and adjacent, wall 49, and extends radially inwardly from the radially inner surface of wall 46. A highly viscous gel or other material, such as silicone putty, is disposed between wall 46 and rotor 76, and also between wall 49 and the rotor. The putty controls the rotation response of rotor 76 for any level of diaphragm force, and to a minor extent inhibits downward movement of the rotor. A flexible pawl 78 extends radially inwardly, and engages the sloped track 68 during the accumulation cycle.

The axially inner surface of retainer 66 is attached to one end of a flexible, monostable diaphragm 70 that extends substantially radially between walls 52 and 66. Diaphragm 70 has a radially outer end that is seated in a gap between walls 46 and 52, and has a radially inner end that is engaged with the inner surface of retainer 66. Diaphragm 70 is normally biased towards a stable closed position, as illustrated in FIGS. 1–3. The pressure generated within the accumulation chamber 71 during accumulation cycles forces the diaphragm from the stable position towards a second, unstable position, illustrated in FIG. 5. Once the diaphragm is in the position illustrated in FIG. 5, the spray cycle is initiated. FIG. 4 illustrates the diaphragm in an unstable state during the transition from the accumulation cycle to the spray cycle.

Diaphragm 70 is substantially bow-shaped, and has a convex outer surface that touches wall 50 closed such that accumulation chamber 71 has an axially extending section 72 and a radially extending section 74. Axially extending section 72 is defined by the radially inner surfaces of retainer 66 and diaphragm 70, radially outer surface of wall 54, and axially outer surface of wall 50. Radially extending section 74 is defined by axially inner surface of diaphragm 70, axially outer surface of wall 50, and radially inner surface of flange 52. An orifice 75 extends axially through the diaphragm 70 so as to provide fluid communication between sections 72 and 74 during the accumulation and spray cycles. A pair of notches 73 is disposed in the convex surface to assist in the transition of diaphragm between its closed and open positions, as will be described in more detail below.

Still referring to FIG. 3, during operation the valve assembly 32 is rotated to initiate the accumulation cycle, and aerosol content flows through conduit 42 along the direction of arrow B. The aerosol content is then forced to travel through channel 56 and into the accumulation chamber 71. Because the radially inner surface of retainer member 66 provides a barrier to channel 63, the aerosol content stored within accumulation chamber 71 is unable to exit through channel 63. As shown in FIG. 7, the inner surface can be cupped, if desired. Aerosol content is thus forced to build up within axially extending section 72 of accumulation chamber 71. As pressure accumulates within section 72, retainer member 66 begins to become displaced axially downstream.

Referring now to FIG. 4, the radially inner portion of diaphragm 70 also becomes axially displaced due to pressure within axial section 72. This removes the diaphragm 70 from contact with wall 50, and allows the aerosol content occupying axial section 72 to travel into radial section 74 along the direction of arrow D via orifice 75 as additional aerosol content enters channel 56 from can 22. As aerosol content continues to accumulate in the chamber 71, the pressure continuously biases diaphragm 70 and retainer 66 axially outwardly.

As the diaphragm 70 and retainer 66 become displaced, pawl 78 is urged to rotate under forces provided via the engagement with the sloped track 68. Accordingly, pawl 78 translates its rotational motion to the rotor 76, which rotates under resistance from the viscous gel. Rotor 76 is thereby continuously rotated under forces provided by the engagement of the pawl 78 with the sloped track 68.

Figure 5:
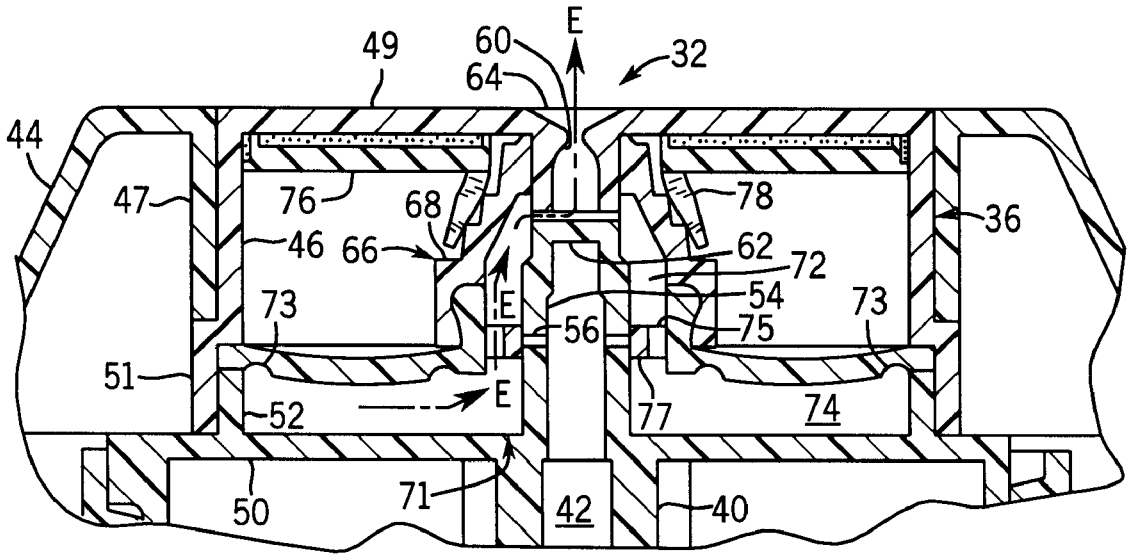
FIG. 5 is a view similar to FIG. 4, but with the valve in a spray configuration.

Referring now to FIG. 5, once the pressure within accumulation chamber 71 reaches a predetermined threshold, the diaphragm 70 and retainer wall 66 become biased sufficiently axially outwardly so as to terminate the accumulation cycle, and begin the spray cycle. In particular, as the retainer 66 is biased towards its fully axially outward position, the seal between channel 63 and retainer is removed. The aerosol contents stored under pressure within the accumulation chamber 71 then burst along the direction of arrow E from chamber 71, through channel 63, and out the dispenser 20 at the outlet 64.

As the seal between the retainer 66 and channel 63 is removed, the pawl 78 becomes biased sufficiently radially outwardly so as to slide off the sloped track 68, thereby removing most of the resistance to the axial displacement of the diaphragm. This allows a quick blast of aerosol content out the dispenser 20. It should be apparent to one having ordinary skill in the art that the pressure threshold within accumulation chamber 71 is at least partially dependent on the viscosity of the gel as well as the spring coefficient of diaphragm 70.

Diaphragm 70 further includes an annular hub 77 disposed radially inwardly with respect to orifice 75. Hub 77 has an inner diameter approximately equal to the outer diameter of wall 54 so as to slide therealong during operation. Once the pressure within accumulation chamber 71 has reached the predetermined threshold, and the diaphragm is biased to its full axially outer position, hub 77 becomes radially aligned with, and provides blockage to, channel 56. Again, a cupped contacting surface (not shown) could alternatively be provided. As a result, leakage is minimized between the conduit 42 and accumulation chamber 71 during the spray cycle. Because aerosol content is thus prevented from flowing freely from the can 22 into the accumulation chamber 71 during this portion of the cycle, the output spray is substantially limited to the aerosol content that was stored in the accumulation chamber 71 during the previous accumulation cycle.

Once the pressure within the chamber has abated so as to be below a predetermined threshold, the internal spring force of diaphragm 70 biases the diaphragm and retainer 66 axially inwardly to the closed position illustrated and described above with reference to FIG. 3. The seal between hub 75 and channel 56 is thus removed, and the seal between retainer 66 and channel 63 is re-established. Additionally, pawl 78 re-engages the sloped track 68. Accordingly, as described above, aerosol content flows from the can 22 and into the accumulation chamber 71 to begin a new accumulation cycle.

Thus, aerosol content may be emitted at predetermined time intervals without the need for any electrical power. As a result, the can 22 and dispenser 20 are fully portable, and may be used wherever the efflux of aerosol content is desired. Moreover, the dispenser may be disengaged and re-engaged with the can 22 by rotating wall 44 counter-clockwise and clockwise, respectively, as described above.

Many modifications may be made to the first illustrated embodiment without departing from the present invention. For example, the diaphragm 70 may be designed to be stable at a point where it does not touch wall 50. During the accumulation cycle, the aerosol content would accumulate directly within both the axial and radial sections the chamber 71 without the need to initially lift the diaphragm 70.

Figure 6:
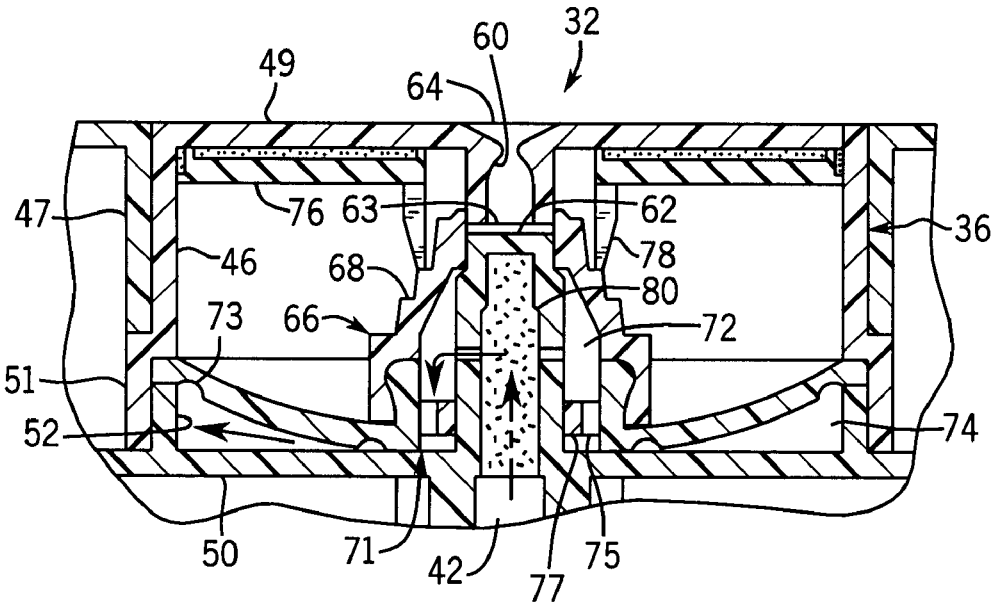
FIG. 6 is a view similar to FIG. 3, but of a second embodiment that includes a porous barrier.

Furthermore, as illustrated in FIG. 6, the flow of aerosol content from the can 22 to the chamber 71 may be further controlled using a flow regulator, such as a porous gasket 80. Where gasket 80 is disposed in conduit 42, any aerosol content flowing from can 22 into the chamber 71 must pass through it, and thereby be slowed. Gasket 80 is preferably made of an open-celled foam or any other similarly permeable material. The installation of gasket 80 thus limits the flow rate of aerosol content from the can 22 to correspondingly prolong the accumulation cycle and decrease the frequency of sprays during operation.

As illustrated in FIG. 7, the frequency of iterations between the accumulation cycle and spray cycle can be further controlled using a spring 82. In particular, dispenser 20 could be constructed to further include a coil spring 82 that extends around neck 60, and between the axially inner surface of cover 49 and axially outer surface of retainer 66. Accordingly, the spring force biases the retainer 66 radially inwardly, and resists the axially outward displacement of retainer 66 in response to pressure within the accumulation chamber 71. The pressure threshold within the chamber 71 to initiate the spray cycle is thereby increased, thereby also increasing the amount of time during accumulation cycles.

Figure 8:
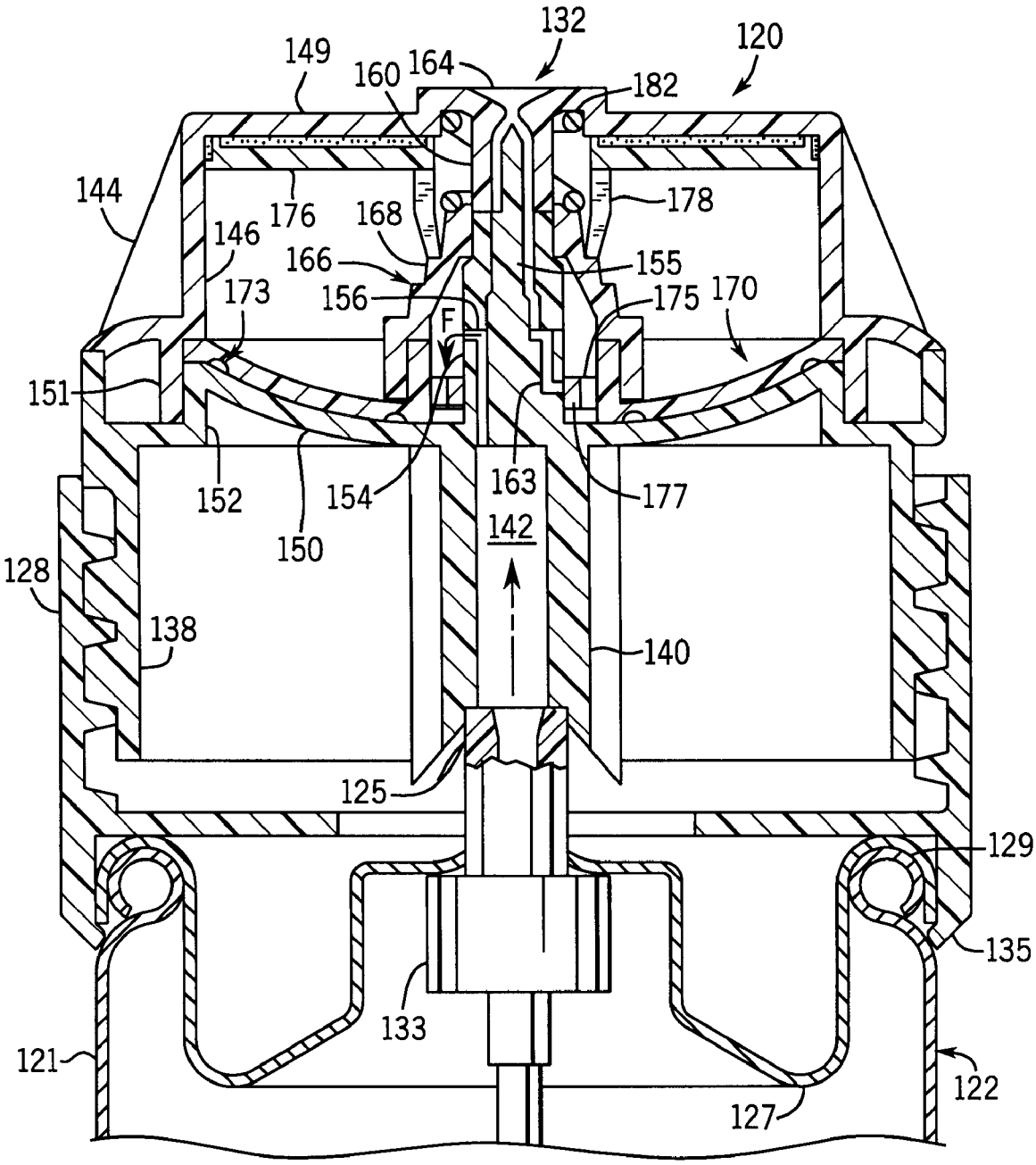
FIG. 8 is a view similar to FIG. 2, but of a fourth embodiment that includes an accumulation chamber with a sloped lower wall.

Another alternate embodiment is illustrated in FIGS. 8 and 9, in which reference numerals corresponding to like elements of the previous embodiment are incremented by 100 for the sake of clarity and convenience. In particular, dispenser 120 is configured to be mounted onto an aerosol can 122 that terminates at its radial end with a valve cup rim 129 rather than the chime described above. Accordingly, the mounting assembly includes a threaded wall 128 having a radially inwardly extending flange 135 that engages the valve cup rim to securely mount the dispenser 120 onto the can 122. Threaded wall 128 receives correspondingly threaded wall 138 such that a user rotates wall 144 to actuate the dispenser 120.

Dispenser 120 includes a curved wall 150 that defines the base of accumulation chamber 171. Wall 150 follows the general contour of diaphragm 171, and is in contact with the diaphragm at the beginning of the accumulation cycle. This ensures that substantially all aerosol content stored in the radial section 174 escapes during the spray cycle, thereby preventing liquid aerosol content from pooling in the radial section. During the accumulation cycle, the diaphragm becomes axially displaced from wall 150 to define the radially extending portion 72 of the accumulation chamber, as described above.

Dispenser 120 includes a stem 155 that extends axially between conduit 142 and outlet end 146. Stem 155 is radially displaced on one side from the axially inner portion of wall 154 so as to define an intake channel 156 that extends between conduit 142 and axial section 172 of chamber 171. Stem 155 is radially displaced on its other side from the entire radial inner surface of wall 154 so as to define an outlet channel that extends between the axially extending section 172 and the outlet end 164. The openings of channels 156 and 163 into the axial section 172 are axially displaced from one another by the amount of axial travel by the diaphragm 170 between the accumulation and spray cycles.

During the accumulation cycle, hub 177 is radially aligned with channel 163 to form a seal which prevents the aerosol content from escaping the accumulation chamber 171. Accordingly, the aerosol content is only permitted to flow through intake channel 156 along the direction of arrow F into accumulation chamber 171. Once the pressure within the chamber 171 has biased the diaphragm 170 and retainer 166 axially outwardly, hub 177 falls out of alignment with channel outlet channel 163 and becomes radially aligned with intake channel 156 to provide a blockage thereto. The aerosol content then flows from accumulation chamber 171 along the direction of arrow F, through outtake channel 163, and out the outlet end 164.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

Industrial Applicability

The present invention provides automated dispenser assemblies for dispensing aerosol can contents without requiring the use of electric power.

We claim:

1. A valve assembly that is suitable to dispense a chemical from an aerosol container, the valve assembly being of the type that can automatically iterate between an accumulation phase where the chemical is received from the container, and a spray phase where the received chemical is automatically dispensed at intervals, the valve assembly comprising:

a housing mountable on an aerosol container;

a movable diaphragm associated with the housing which is linked to a sloped track, the diaphragm being biased towards a first configuration;

an accumulation chamber inside the housing for providing variable pressure against the diaphragm;

a first passageway in the housing suitable for linking an interior portion of the aerosol container with the accumulation chamber;

a second passageway in the housing suitable for linking the accumulation chamber with an outlet of the valve assembly;

a valve stem positioned in the housing which the sloped track can ride along; and a pawl rotatably positionable on the sloped track to ride on at least a portion of the sloped track;

whereby when the diaphragm is in the first configuration the valve assembly can prevent spray of the chemical out of the valve assembly and permit chemical to flow from the aerosol container into the accumulation chamber via the first passageway; and whereby when the pressure of chemical inside the accumulation chamber exceeds a specified threshold the diaphragm can move from the first configuration to a second configuration wherein spray is permitted to exit the valve assembly.

2. The valve assembly as recited in claim 1, wherein a portion of the diaphragm at least partially blocks off the first passageway when the diaphragm is in the second configuration.

3. The valve assembly as recited in claim 1, wherein a portion of the sloped track at least partially blocks off the second passageway when the diaphragm is in the first configuration.

4. The valve assembly as recited in claim 1, wherein the pawl is linked to a rotor, the rotor having an upper surface at least partially coated with a putty.

5. The valve assembly as recited in claim 1, wherein the sloped track is helically sloped, the pawl can ride thereon to resist movement of the diaphragm from the first configuration to the second configuration, and pressure supplied by the diaphragm towards the pawl can cause the pawl to rotate thereby permitting movement of the diaphragm towards the second configuration.

6. The valve assembly as recited in claim 5, wherein a toe of the pawl can flare radially outwardly off of the track as the diaphragm approaches the second configuration.

7. The valve assembly as recited in claim 1, wherein the diaphragm has a radially outward section, a radially inward section, and an orifice there between.

8. The valve assembly as recited in claim 1, wherein the accumulation chamber has a base that is sloped so as to direct liquid chemical that may collect in the accumulation chamber towards the first passageway.

9. The valve assembly as recited in claim 1, further comprising a spring disposed in the housing operable to resist axial movement of the diaphragm from the first to the second configuration.

10. The valve assembly as recited in claim 1, further comprising a porous barrier disposed in the housing between the aerosol container and the first passageway to regulate the flow of chemical passing there through.

11. A method of automatically delivering a chemical from an aerosol container to an ambient environment at predetermined intervals, the method comprising the steps of:

(a) providing a valve assembly suitable for use to dispense a chemical from the aerosol container, the valve assembly being of the type that can automatically iterate without the use of electrical power between an accumulation phase where the chemical is received from the container, and a spray phase where the received chemical is automatically dispensed at intervals, the valve assembly comprising:

(i) a housing mountable on an aerosol container;

(ii) a movable diaphragm associated with the housing which is linked to a sloped track, the diaphragm being biased towards a first configuration;

(iii) an accumulation chamber inside the housing for providing variable pressure against the diaphragm;

(iv) a first passageway in the housing suitable for linking an interior portion of the aerosol container with the accumulation chamber;

(v) a second passageway in the housing suitable for linking the accumulation chamber with an outlet of the valve assembly;

(vi) a valve stem positioned in the housing which the sloped track can ride along; and (vii) a pawl rotatably positioned on the sloped track to ride on at least a portion of the sloped track; whereby when the diaphragm is in the first configuration the valve assembly can prevent spray of the chemical from the valve assembly; and whereby when the pressure of chemical inside the accumulation chamber exceeds a specified threshold, the diaphragm can move from the first configuration to a second configuration where chemical is permitted to spray from the valve assembly;

(b) mounting the valve assembly to such an aerosol container; and (c) actuating the valve assembly.

* * * * *